United States Patent [19]

Imazu et al.

[11] Patent Number: 4,948,487

[45] Date of Patent: Aug. 14, 1990

[54] ELECTROLYTIC PROCESSING APPARATUS FOR METALLIC MEMBERS

[75] Inventors: Tsukasa Imazu; Mitsuo Kimura; Yoshiyuki Saito; Nobuyoshi Ishiwatari; Yoshio Miyano; Mikio Kondo, all of Chiba, Japan

[73] Assignee: Kawasaki Steel Corp.

[21] Appl. No.: 441,886

[22] Filed: Nov. 27, 1989

[30] Foreign Application Priority Data

| | | | |
|---|---|---|---|
| Nov. 29, 1988 | [JP] | Japan | 63-301788 |
| Jan. 5, 1989 | [JP] | Japan | 64-795 |
| May 24, 1989 | [JP] | Japan | 1-130464 |

[51] Int. Cl.[5] ..... C25O 17/00

[52] U.S. Cl. ..... 204/206; 204/224 R

[58] Field of Search ..... 204/206, 224 R

[56] References Cited

U.S. PATENT DOCUMENTS

| | | | |
|---|---|---|---|
| 3,048,528 | 8/1962 | Covington | 204/224 R |
| 4,800,001 | 1/1989 | Ott | 204/224 R |

*Primary Examiner*—T. M. Tufariello

*Attorney, Agent, or Firm*—Austin R. Miller

[57] ABSTRACT

An apparatus for effecting, on a metallic member, an electrolytic process such as descaling, electrolytic acid cleaning, passivation, electrolytic polishing, coloring or plating. The apparatus comprises a rotatable cylindrical electrode arranged to oppose the member to be processed, with a gap between them, a paste electrolyte supply device for introducing a paste electrolyte into the gap between the cylindrical electrode and the metallic member, a pad disposed on the outer peripheral surface of the cylindrical electrode and capable of retaining by impregnation the paste electrolyte supplied by the paste electrolyte supply device; an electrical power supply device for causing an electric current to flow between the cylindrical electrode and the member across the paste electrolyte; and a moving device for effecting relative movement between said metallic member and said cylindrical electrode.

7 Claims, 10 Drawing Sheets

ELECTROLYTIC PROCESSING APPARATUS FOR METALLIC MEMBERS

BACKGROUND OF THE INVENTION

1. Field of the Invention

The present invention relates to an apparatus for electrolytic processing of a metallic member, such as by performing descaling, electrolytic polishing, passivation, coloring or electrolytic plating operations.

2. Description of the Prior Art

Various types of processing of metal surfaces have been used, such as descaling, surface polishing, passivation, coloring and plating. Each of these processes can be carried out mechanically, chemically or electrochemically. The chemical and electro-chemical processes suffer from the following disadvantages.

One of the typical chemical processes is descaling by pickling. In general, a considerably long processing time is required for descaling by pickling. In addition, a large-scale solution-disposal system has to be installed and operated for the purpose of preventing pollution which may otherwise be caused due to the use of an acidic solution. It is true that in recent years pickling with a pickling paste has been used, but this method still requires substantial processing time and tends to cause uneven pickling over the surface of the metal.

A typical example of electro-chemical processing is descaling by electrolytic acid cleaning. This process appreciably shortens the processing time but requires a processing system which is exclusively used for this purpose.

OBJECT OF THE INVENTION

Accordingly, an object of the present invention is to provide an apparatus which is capable of processing a metal surface smoothly at a high processing efficiency and with a high processing quality, not requiring a large-scale solution-disposal system, not requiring unduly long processing time and in general overcoming the above-described problems of the prior art.

The foregoing and other objects of this invention are attained by this invention, which is shown by way of example, but not by way of limitation, in the following drawings:

Figure 3:
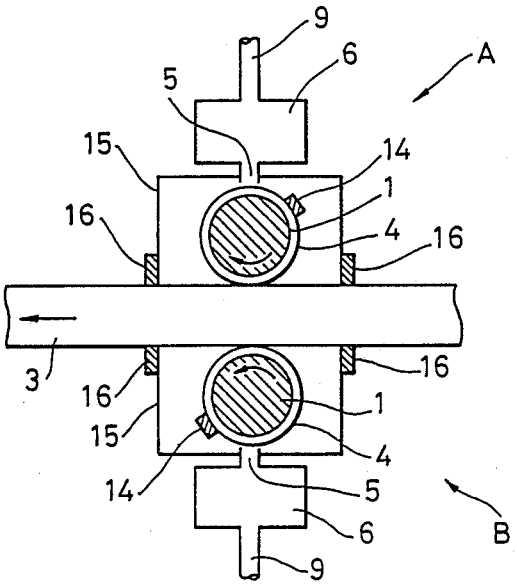
Figure 4:
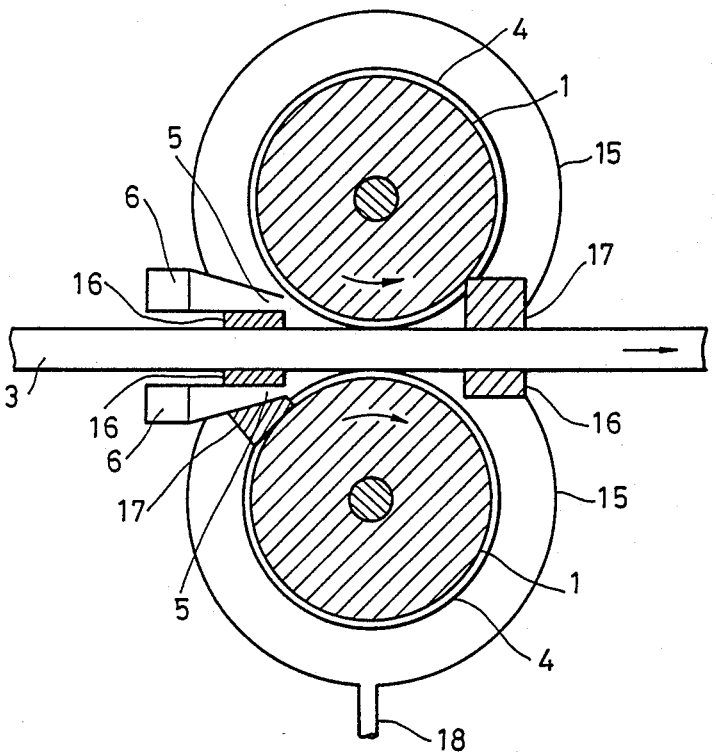
Figure 5:
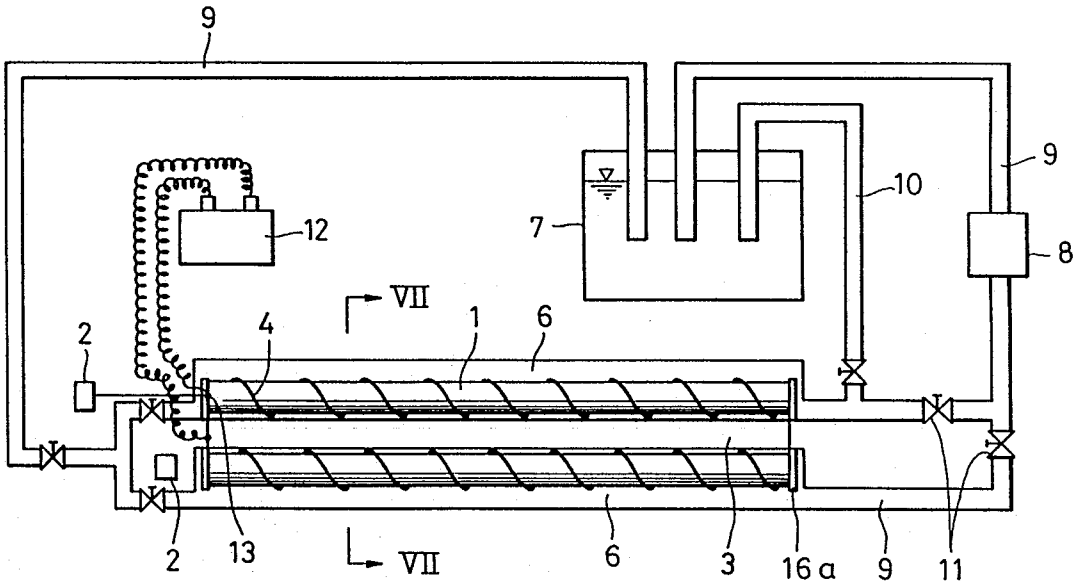
Figure 6:
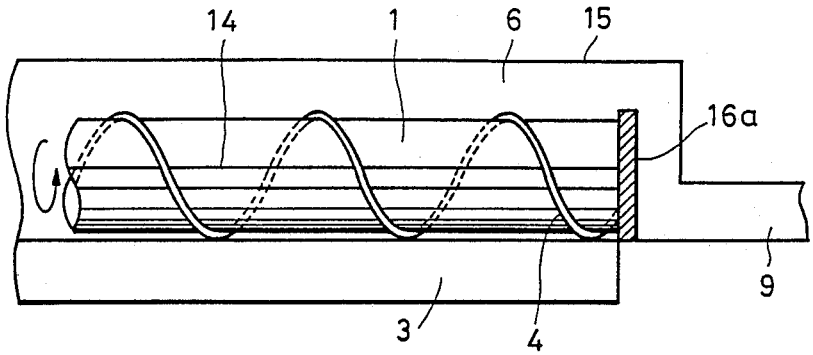
Figure 7:
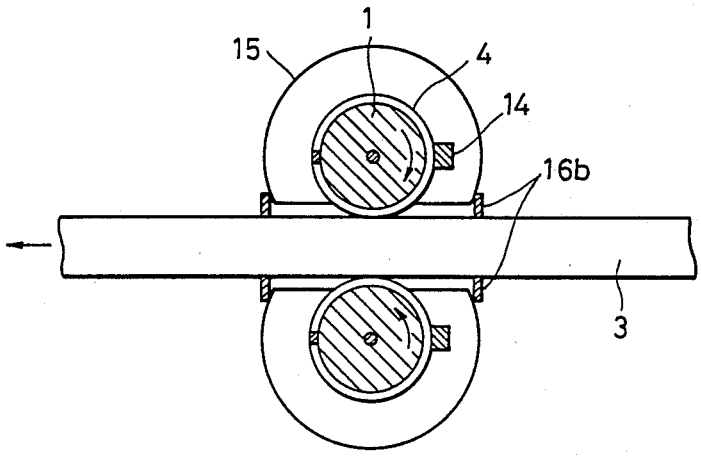

FIGS. *2a*, *2b* and *2c* show as examples certain patterns in which pads are arranged on the outer surface of a cylindrical electrode;

FIG. 3 is a sectional view of an example of electrolytic processing apparatus capable of treating both sides of a metallic member;

FIG. 4 is a sectional view of another example of electrolytic processing apparatus capable of treating both sides of a metallic member;

FIG. 5 is a schematic illustration of an electrolytic processing apparatus capable of processing only one or both sides of a metallic member;

FIG. 6 is an enlarged sectional view of the apparatus shown in FIG. 5, illustrating in particular the cylindrical electrode, pads and a paste sealing member;

FIG. 7 is a sectional view taken along the line VII—VII of FIG. 5;

FIG. *8a* is a front elevational view of an electrolytic processing apparatus of the invention having five pairs of cylindrical electrodes, illustrating particularly the cylindrical electrode and an electrode driving unit;

FIG. *8b* is a side elevational view of the apparatus shown in FIG. *8a;*

Figure 10:
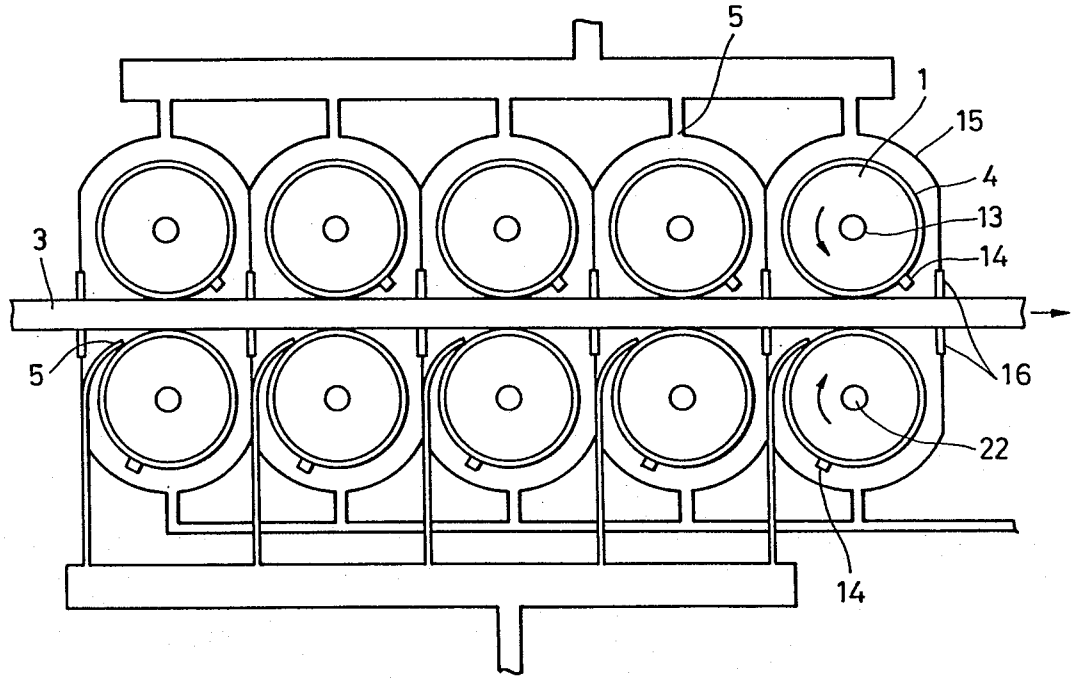

FIG. *9a* is a diagram showing means for supplying a paste to the cylindrical electrodes of the apparatus shown in FIGS. *8a* and *8b*, as well as to a metallic member to be processed;

FIG. *9b* is a diagram showing electrical power supplying means;

FIG. 10 is an enlarged fragmentary sectional view of the apparatus shown in FIGS. *8a* and *8b*, illustrating particularly the cylindrical electrode, paste supply port and a portion of a metallic member to be processed.

Figure 11:
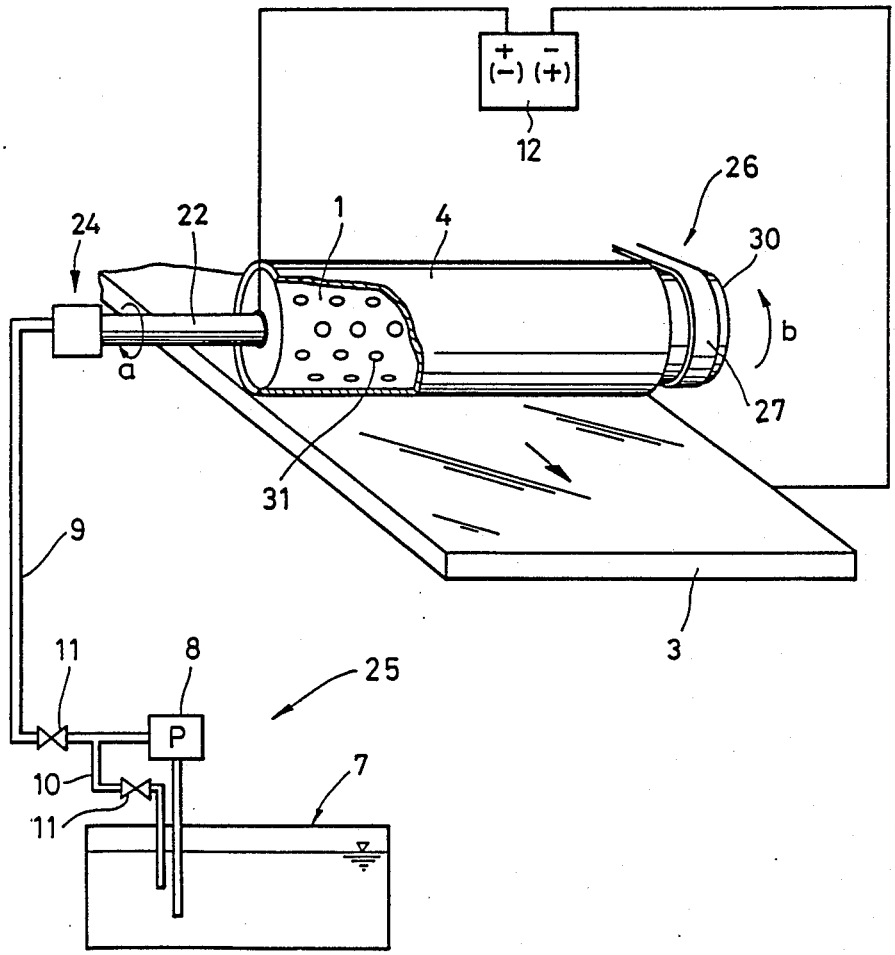
Figure 12:
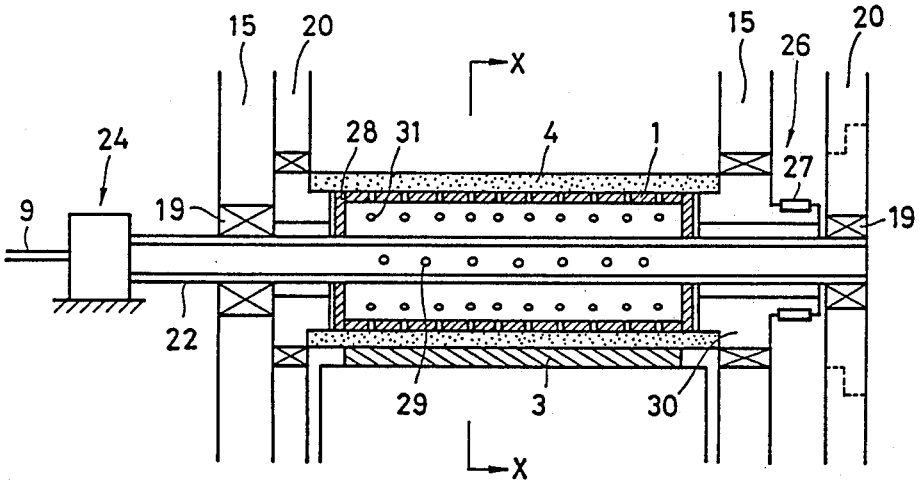
Figure 13:
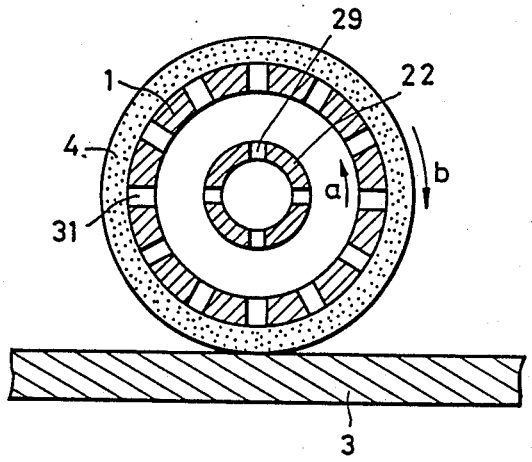

FIG. 11 is a schematic illustration of another embodiment of the electrolytic processing apparatus of the present invention;

FIG. 12 is an elevation in section of a cylindrical electrode and a cylindrical electrode drive shaft shown in FIG. 11; and FIG. 13 is a cross-sectional view taken on line X—X of FIG. 12, illustrating particularly the cylindrical electrode, cylindrical electrode drive shaft, pads and a metallic member to be processed.

The description which follows is not intended to define or to limit the scope of the invention, and specific terms will be used for the sake of clarity in describing the specific embodiments selected for illustration in the drawings.

DESCRIPTION OF THE PREFERRED EMBODIMENTS

Figure 1:
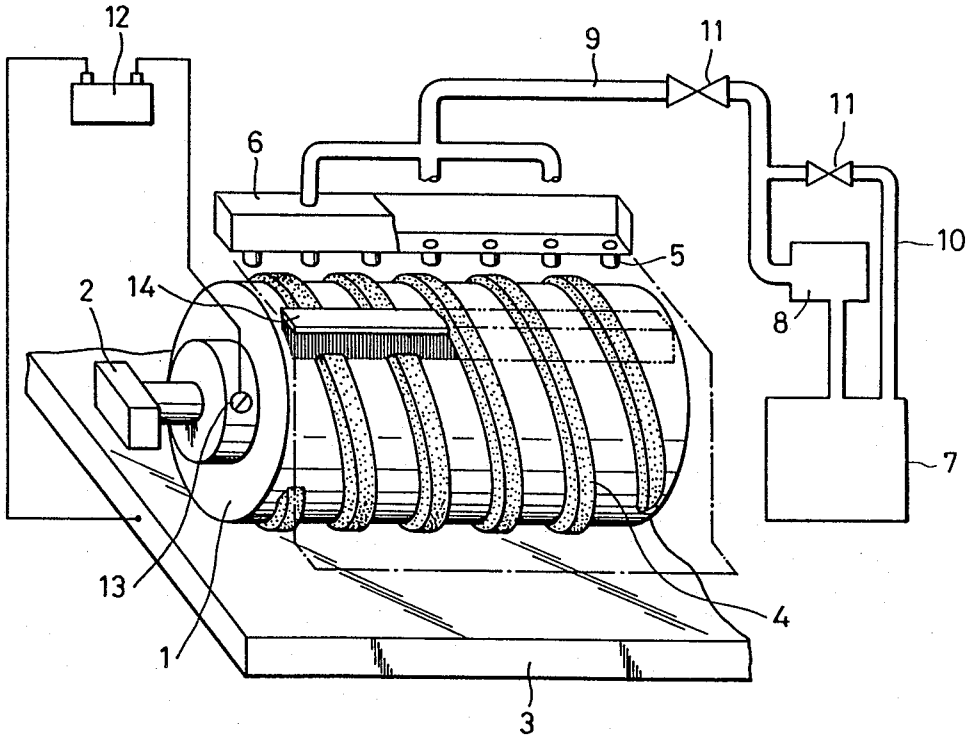
FIG. 1 is a schematic illustration of an embodiment of the electrolytic apparatus for processing a metallic member in accordance with the present invention.

Referring first to FIG. 1 showing one example of an electrolytic processing apparatus of the present invention, a cylindrical electrode 1 is mounted so as to be rotatingly driven by a motor 2. The cylindrical electrode 1 is so oriented that its axis extends in a predetermined direction with respect to the surface of a metallic member 3 to be treated, for example, arranged transversely of the metallic member 3.

The cylindrical electrode 1 is preferably made of stainless steel, although other suitable electrically conductive materials may be used.

A pad 4 is provided on the surface of the barrel portion of the cylindrical electrode 1 such that the pad 4 contacts the surface of the metallic member 3 to be processed in accordance with the rotation of the cylindrical electrode 1.

The pad 4 is preferably made of a material which can be impregnated with liquid. When the apparatus is used for a descaling purpose, the pad 4 is preferably made of a comparatively hard material so that it may scrape oxide scale off the metal surface, and may comprise an electrically insulating woven or knit cloth of polyester fiber, glass fiber, alumina fiber or the like, impregnated with a polishing agent.

Figure 2A:
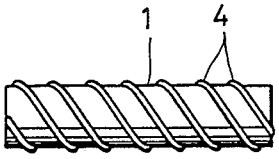
Figure 2B:
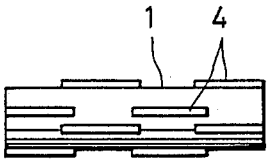
Figure 2C:
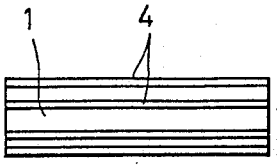

When the apparatus is used for plating the metallic member 3 the pad 4 is preferably made of a comparatively soft material, e.g., nylon fibers, so as to remove bubbles of gas generated at the surface of the metallic member 3, thereby ensuring required electric conductivity without damaging the surface of the metallic member 3. A single pad 4 may be provided in a spiral form on the cylindrical electrode 1 as shown in FIG. 1 and FIG. *2a* or segments of the pad may be attached to the surface of the cylindrical electrode 1 so as to discontinuously or continuously extend in the axial direction as shown in FIGS. 2*b* and 2*c*. A paste trap 6 (FIG. 1) having a plurality of paste supply ports 5 for supplying an electrically conductive paste P to the surface of the cylindrical electrode 1 is provided above the cylindrical electrode 1.

The conductive paste supply system includes a pipe 9 through which the conductive paste P is supplied from a paste tank 7 to the paste trap 6 by means of a pump 8. Numerals 10 and 11 denote a by-pass pipe and a control valve, respectively.

When the cylindrical electrode 1 is rotated by the motor 2 while the conductive paste P is supplied onto the cylindrical electrode 1 through the supply ports of the paste trap 6, the gap between the cylindrical electrode 1 and the material 3 to be processed is charged with and occupied by the electrically conductive paste P.

The paste P may contain sulfuric acid or electrolyte when used for general descaling or for passivation of stainless steel. When the apparatus is used for a plating purpose, a paste containing metallic ions, for example, $Zn^{++}$, $Cu^{++}$ or $Ni^{++}$, may be used as the paste P. Anyway, the paste preferably has a moderate level of tackiness.

Electric wires are connected from a D.C. power supply 12 to a carbon brush 13 on the cylindrical electrode 1 and also to the material 3 to be processed.

In the case of descaling or passivation of a stainless steel member, the plus (+) and minus (−) sides of the power supply are connected, respectively, to the material 3 and the cylindrical electrode 1, whereas, in case of plating, the cylindrical electrode 1 and the material 3 are respectively connected to the plus (+) and minus (−) sides of the power supply.

The quality of surface processing is affected by the efficiency of supply of the electrical current, so that it is important to keep the electrode clean. It is therefore preferred to provide an electrode cleaner such as cleaner 14 in FIG. 1.

The electrode cleaner 14 may have a brush-like form and should have excellent anti-acid and anti-wear characteristics.

A description will now be given of the case where the electrolytic processing apparatus of the present invention is used for processing both surfaces of the metallic material 3.

Referring to FIG. 3, the electrolytic processing apparatus has an upper unit A having the same construction as the apparatus shown in FIG. 1 and held in contact with the upper surface of the material 3 to be processed, and also has a lower unit B having the same construction as the upper unit A and held in contact with the lower surface of the material 3. Numeral 15 denotes a housing which covers the cylindrical electrode 1.

The apparatus shown in FIG. 3 has paste seal members 16 provided in the inlet and outlet for the metallic material 3 to be processed, in order to prevent the conductive paste P from escaping through the clearance between the walls of the housing 15 and the material 3 to be processed. The paste seal members 16 may be made of the same material as the pad 4.

FIG. 4 shows another example of the conductive paste supply system. In this system, a pair of paste traps 6 are provided to supply the paste P to regions near the surfaces to be processed, i.e., to the regions near both cylindrical electrodes 1 and the adjacent surfaces to be processed. Thus, the paste traps 6 are provided at the inlet side of the housing 15 with their supply ports 5 directed toward the outlet for the material 3. Each housing 15 has a substantially cylindrical form. A paste seal member 16 is disposed between the housing 15 and the material 3 to be processed. An electrode cleaner-and-seal member 17 is provided at the outlet for the metallic material 3 in contact with the upper surface of the metallic material 3. A similar electrode cleaner-and-seal member 17 is provided at the inlet for the metallic material 3 in contact with the lower surface of the metallic material 3. Numeral 18 denotes a paste discharge port provided in the bottom of the lower housing 15.

This arrangement enables the overall height of the electrolytic processing apparatus to be reduced. The conductive paste P is supplied in a sheet-like form through the supply port 5 which opens in a flattened form over the entire axial length of the cylindrical electrode 1, so that a high plating efficiency can be achieved with quite a reduced amount of paste P.

The cylindrical electrode 1 of the electrolytic processing apparatus may be carried by a suitable moving means such as a car or, alternatively, means may be provided for moving the metallic material 3 under processing. Such moving means enables electrolytic acid cleaning, plating, passivation and other electrolytic processes to be performed automatically.

FIG. 5 shows an electrolytic processing apparatus which enables either side, only the upper side or only the lower side of the material 3 to be processed.

In the apparatus shown in FIG. 5, the supply of the electrically conductive paste P to the cylindrical electrode 1, to the metallic material 3 to be processed and to the pads 4 is conducted as follows. Namely, the paste P is supplied by a pump 8 through a pipe 9 and a control valve 11 so as to be supplied to the lower cylindrical electrode 1 along the axial direction thereof so that the lower paste trap 6 is filled with the paste P. After an electrolytic process has been performed in the lower paste trap 6, the conductive paste P is introduced to the paste trap 6 on the other side of the material 3, i.e., to the upper paste trap 6, through a pipe 9 and a control valve 11 so that a further electrolytic process is performed on the upper side of the metallic material 3. After completion of this electrolytic process, the conductive paste P is returned to the paste tank 7.

In the apparatus shown in FIG. 5, each cylindrical electrode 1 is rotated by a motor 2 while the conductive paste P is supplied by the pump 8 through the pipe 9 so that the gap between the cylindrical electrode 1 and the adjacent surface of the material 3 is filled with the paste P. A D.C. power supply 12 is used to supply electrical power to both cylindrical electrodes 1 through respective carbon brushes 13 and also to the material 3 to be processed.

FIG. 6 is an enlarged view showing the cylindrical electrode 1, pad 4 and a paste seal member 16*a*, while FIG. 7 is a sectional view taken along the line VII—VII of FIG. 5.

Preferably, electrode cleaners 14 are provided as shown in FIGS. 6 and 7 so as to keep the electrodes clean.

Paste seal member 16*a* and 16*b* are provided in order to prevent the paste P from escaping from the ends of the material 3 or through the gaps between the housing 15 and the material 3. Within this apparatus, it is possible to automatically conduct various electrolytic processes on stainless steel members or stainless steel-clad members, such as electrolytic acid cleaning, passivation and electrolytic plating.

Figure 8A:
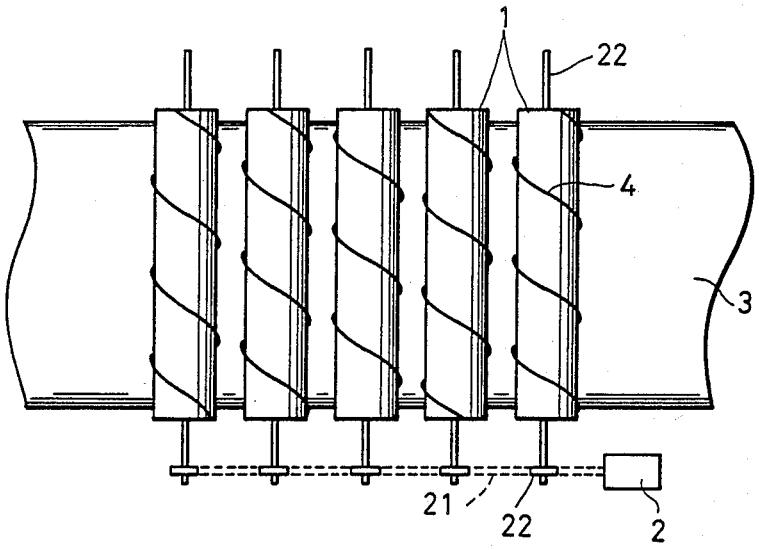
Figure 8B:
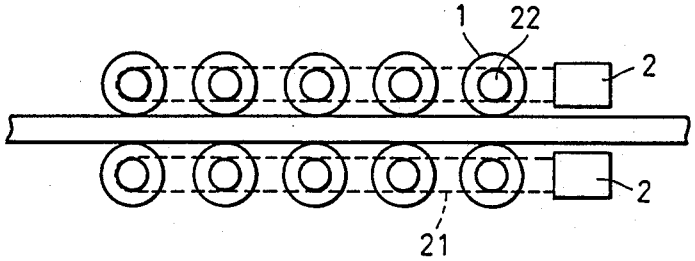

FIGS. 8*a* and 8*b* show a modification of the electrolytic apparatus of the present invention, in which a plurality of cylindrical electrodes are arranged to face one surface of the metal to be processed.

This modification of the electrolytic processing apparatus has five pairs of cylindrical electrodes 1. FIG. 8*a* shows five cylindrical electrodes 1 arranged on one side of the material 3 and associated electrode drive device, while FIG. 8*b* is a side elevational view of the apparatus.

In this electrolytic processing apparatus, as shown in FIGS. 8*a* and 8*b*, five cylindrical electrodes 1 arranged on each side of the material 3 are driven by a motor 2 through a suitable driving power transmission device 21 such as a chain and sprockets. The metallic material 3 to be processed and the electrolytic processing apparatus including the cylindrical electrode 1 and other components are moved relative to each other. Numeral 22 denotes the drive shaft of each cylindrical electrode.

Figure 9A:
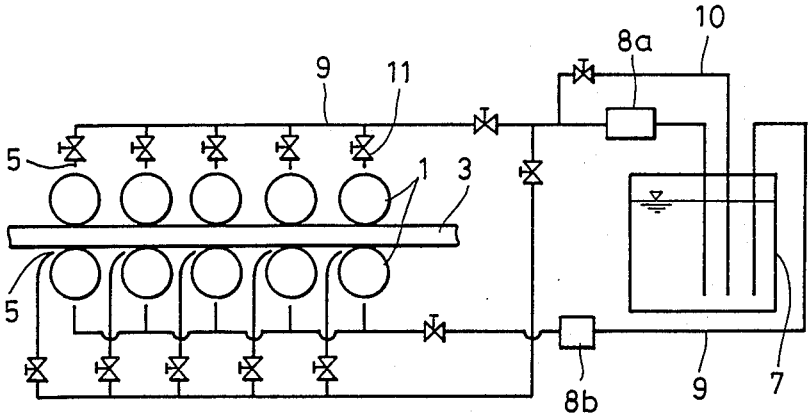
Figure 9B:
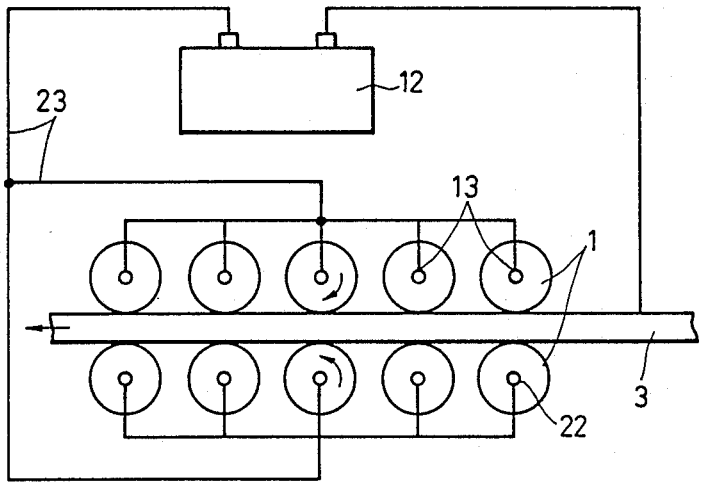

FIG. 9*a* is a diagram showing a paste supply system for supplying the cylindrical electrodes 1 of FIGS. 8*a* and 8*b* with a conductive paste, while FIG. 9*b* is a diagram showing the wiring of an electrical power supply to the material 3 to be processed and to the cylindrical electrodes 1.

FIG. 10 is an enlarged view showing cylindrical electrodes 1 and associated paste supply ports.

The supply of paste P to the gap between the cylindrical electrodes 1 and the material 3 to be processed is executed by a pump 8*a* as shown in FIG. 9*a*. Since a control valve 11 is provided in each of the paste supply pipes 9, it is possible to provide a stable paste supply. The paste P after electrolytic processing is returned to the paste tank 7 by means of a pump 8*b*. Numeral 5 denotes ports for supplying the paste.

A D.C. power supply 12 supplies electrical power to both the cylindrical electrodes 1 on the upper and lower sides of the material 3 to be processed, through parallel lines 23, electrode drive shafts 22 and carbon brushes 13. The material 3 is directly supplied with electricity from the power supply 12 through a parallel line 23.

It is important to keep the electrodes clean also in the arrangement shown in FIGS. 8*a*, 8*b*, 9*a* and 9*b* because the quality of surface processing is largely affected by the current efficiency. It is therefore preferred that an electrode cleaner 14 is provided in contact with each cylindrical electrode 1 as shown in FIG. 10.

In order to prevent escape of the paste P through the gaps between the housings 15 and the material 3 under processing, paste seal members 16 are provided both at the inlet and outlet of the apparatus, both at the upper and lower sides of the material 3 under processing.

A description will now be given of another modification of the electrolytic processing apparatus of the invention, in which the electrolytic processing paste is supplied from the inside of the cylindrical electrode through the pad.

Such a modification is shown in FIG. 11. This apparatus is designed to enable the surface of a material 3 to be processed with a paste P. The apparatus is basically composed of a hollow cylindrical electrode 1, an electrode drive shaft 22 for driving the cylindrical electrode 1, a pump 8 for supplying the paste P into the space inside the cylindrical electrode 1, a pad 4 covering the cylindrical electrode 1 and capable of allowing flowable conductive paste from the interior of the cylindrical electrode 1 to permeate therethrough so as to cause the paste P to exude from the surface thereof, a pad drive system 26 for causing relative rotation between the pad 4 and the cylindrical electrode 1, and a D.C. power supply 12 for supplying electricity to the cylindrical electrode 1 through the paste P exuding from the pad 4 and also to the metallic material 3 to be processed.

According to the invention, since the cylindrical electrode 1 and the pad 4 rotate relative to each other, it is possible to always keep the surface of the electrode clean, thus ensuring a high current efficiency and, accordingly, a high quality of the surface after processing.

The relative rotation mentioned above may be effected by rotating both members in the same direction at different speeds or in opposite directions, or even by rotating only one of them while keeping the other stationary. Thus, the relative rotation can be effected in various ways by employing various rotation speeds both in the same or opposite directions.

A paste supply system 25 includes a paste tank 7, a pump 8 and a pipe 9. The paste P is supplied by the pump 8 from the tank 7 to the interior of the cylindrical electrode 1 through the pipe 9 under a control effected by a control valve 11, and further through the interior of the electrode drive shaft 22.

The paste supply system 25 also has a by-pass pipe 10 and a control valve 11 so that any excessive paste P supplied by the pump 8 is returned to the paste tank 7 through the by-pass pipe 10.

The conductive paste P supplied through the paste supply system 25 is thus fed into the space in the cylindrical electrode 1 through the electrode drive shaft 22, so as to fill the interior of the cylindrical electrode 1.

As shown in FIG. 12, the electrode drive shaft 22 extends through the cylindrical electrode 1 past the end walls 28 of the cylindrical electrode 1 and is supported by the housing 15 and sub-housing 20 so as to transmit the torque from the electrode drive system 24 comprising of a motor and a decelerator to the cylindrical electrode 1 thereby to rotate the cylindrical shaft in the direction of the arrow a.

The electrode drive shaft 22 is hollow and the pipe 9 is connected to the hollow portion of this drive shaft so that the paste is safely introduced into the space inside the cylindrical electrode 1.

The cylindrical electrode 1 has a plurality of paste outlet ports 31 formed in the cylindrical wall thereof. The paste P flows out of the cylindrical electrode 1 through these paste outlet ports 31 so as to impregnate the pad 4.

A multiplicity of apertures 29 for allowing the paste P to flow therethrough are formed in the cylindrical wall of the portion of the electrode drive shaft 22 inside the cylindrical electrode 1 so that the paste P supplied to the electrode drive shaft 22 is introduced into the space inside the cylindrical electrodes 1. Any suitable arrangement of the apertures 29, i.e., shape, number and positions, may be employed provided that it enables the electrically conductive paste P to adequately and completely fill the interior of the cylindrical electrode 1 so that the paste P is uniformly supplied to the entire area of the pad 4. The same applies also to the arrangement of the outlet ports 31. Namely, any shape, number and position of the outlet ports 31 maybe used provided that the pad 4 is uniformly impregnated with the paste P.

In this electrolytic processing apparatus, it is essential that relative rotation is caused between the pad 4 and the cylindrical electrode 1. Thus, the arrangement may be such that only the pad 4 is rotated while the cylindrical electrode 1 is kept stationary. In such a case, it is not always necessary that the electrode drive shaft 22 is used. The electrode drive shaft 22 and the cylindrical electrode 1 are preferably made from a material such as stainless steel which has sufficiently high corrosion resistance to the acidic paste.

The pad 4 is a cylindrical member which covers the cylindrical electrode 1 so as to be impregnated with the conductive paste P supplied through the outlet ports 31 and so as to make contact with the material 3 to be processed. In the illustrated arrangement, the pad 4 rotates in a direction such as b (FIG. 11), i.e., in the direction opposite to the direction of rotation of the cylindrical electrode 1, so as to realize relative rotation with respect to the cylindrical electrode 1.

Thus, in the described electrolytic processing apparatus, the cylindrical electrode 1, the electrode drive shaft 22, the pad 4 and the material 3 to be processed are arranged in a manner shown by the cross-sectional view comprising FIG. 13. The paste P is introduced into the interior of the cylindrical electrode 1 through the apertures 29 of the drive shaft, and through the outlet ports 31 so as to impregnate the pad 4. The paste impregnating the pad 4 and flowing through the pad 4 then exudes from the surface of the pad 4 so as to contact the material 3 to be processed. In consequence, electricity is supplied from the D.C. power supply 12 to the cylindrical electrode 1 and through the paste P to the material 3 to be processed because a closed circuit is formed through the paste P, whereby the surface of the metallic material 3 is electrolytically processed.

The pad 4 is capable of relative rotation with respect to the cylindrical electrode 1. The pad 4 therefore is preferably provided with a core material made of one or various materials such as a resin, metal or the like, in order to facilitate its rotation. There is no restriction as to the material or construction of the core member, provided it does not hamper impregnation with the paste P. For instance, the core member can have a network-like structure, a lattice-like structure or a spiral structure.

In the illustrated embodiment, the pad 4 is rotated by a pad driving system 26 in the direction opposite to the direction of rotation of the cylindrical electrode, i.e., in the direction indicated by the arrow b (FIG. 11).

The pad driving system 26 has a belt 27 driven by a motor, and a pad drive shaft 30 for transmitting the torque of the belt 27 to the pad 4. In the illustrated electrolytic processing apparatus, the pad 4 is caused to rotate relative to the cylindrical electrode 1 by the pad driving system 26, so that the surface of the cylindrical electrode is always kept clean, thus ensuring high quality of electrolytic surface processing.

Any construction of the pad drive shaft 30 for transmitting the power of the belt 27 to the pad 4 can be used provided that it can suitably transmit the power of the belt 27 to the pad 4.

The electrolytic processing apparatus of the type described is capable of performing various electrolytic processes on the material 3. For instance, when the apparatus is used for plating the paste tank 7 is charged with a predetermined type and amount of plating paste P. The paste supplied into the electrode drive shaft 22 through the paste supply system 25 is then introduced into the interior of the cylindrical electrode 1 through the apertures 29 (see FIG. 12) and is then transferred to the pad 4 through the outlet ports 31 of the cylindrical electrode 1 so as to impregnate and penetrate the pad 4. The paste P then exudes from the surface of the pad 4 so as to contact the surface of the material 3 to be processed. Then, electric current is supplied from the D.C. power supply 12 to the cylindrical electrode 1 and the material 3 to be processed by flowing across the paste P such that the cylindrical electrode forms the plus (+) side while the material 3 forms the minus (−) side across the paste P, whereby the surface of the material 3 is plated.

The described electrolytic processing apparatus may be constructed such that the material 3 to be processed is fed while the apparatus including the cylindrical electrode 1 is stationary or, alternatively, such that the apparatus is moved while the material 3 is kept stationary, during electrolytic processing.

The advantages of the invention will be more fully understood from the following description of practical examples.

Examples 1, 2

Electrolytic acid cleaning was executed under the following conditions, using each apparatus shown in FIG. 3 (Example 1) and in FIG. 4 (Example 2).

The cylindrical electrode used was 60 mm in diameter and 100 mm in length, and was operated at 100 r.p.m. The pad used was made of polyester fibers with addition of a polishing agent. The cylindrical electrode and the pad were assembled in the manner shown in FIG. 1.

The material processed was a steel plate having a hot rolled steel clad sheet only at one side of SUS 304 stainless steel (12 mm thick, 100 mm wide and 500 mm long. cladding layer thickness 2 mm). Acid cleaning was conducted using a paste having the composition shown below, only on the surface of the hot rolled clad steel sheet. The conditions of the electrolytic acid cleaning and the results of evaluation of the unevenness of the processed surface and descaling condition after electrolytic acid cleaning are shown in Table 1. The current value shown in the table is the value of the electric current between the cylindrical electrode and the member processed. Criteria of evaluation of each evaluated item are shown under the table.

| Paste composition | |
|---|---|
| Sodium polyacrylate | 5 wt % |
| Sulfuric acid | 10 wt % |
| Water | 85 wt % |

(Comparison Examples 1, 2)

Test and evaluation were conducted in the same manner as Examples 1 and 2, except that descaling was effected by mechanical grinding (Comparison Example 1) and pickling in a 10% sulfuric acid solution (Comparison Example 2).

TABLE 1

| | Current (A) | Processing speed (cm/min) | Unevenness of processed surface | Descaling effect |
|---|---|---|---|---|
| Example 1 | 3 | 15 | ○ | ◎ |
| | 3 | 30 | ○ | ◎ |
| | 5 | 15 | ○ | ◎ |
| | 5 | 30 | ○ | ◎ |
| Example 2 | 3 | 15 | ○ | ◎ |
| | 3 | 30 | ○ | ◎ |

TABLE 1-continued

| | Current (A) | Processing speed (cm/min) | Unevenness of processed surface | Descaling effect |
|---|---|---|---|---|
| | 5 | 15 | ○ | ◎ |
| | 5 | 30 | ○ | ◎ |
| Comparison Example 1 | — | 10 | Δ | ○ |
| Comparison Example 2 | — | 90 | X | X |

Evaluation criterion

| | |
|---|---|
| Unevenness of processed surface | ○: No unevenness<br>Δ: Slight unevenness<br>X: Large unevenness |
| Descaling effect (visual check) | ◎: Completely descaled<br>○: Over 99%<br>Δ: 90–99%<br>X: below 90% |

In Examples 1 and 2, complete descaling was effected and a smooth surface free of unevenness was formed on the processed surface in all conditions shown in Table 1. On the other hand, Comparison Example 1 processed by grinding showed slight unevenness, while Comparison Example 2 pickled with 10% sulfuric acid solution required a subsequent brushing for the removal of scale. Comparison Examples 1 and 2 also required impractically long processing times, i.e., 10 minutes and 90 minutes, respectively, and complete descaling could not be effected even after such long processing times.

(Example 3)

Using the apparatus shown in FIG. 11, nickel plating was conducted on ordinary steel (SM 50B) 10 mm thick, 100 mm wide and 500 mm long.

The paste P was prepared by adding 10 wt % of xanthane gum as a paste-forming agent to a Watt bath (330 g/l of nickel sulfate, 45 g/l of nickel chloride, 38 g/l of boric acid and the balance water). The cylindrical electrode used had a diameter of 60 mm and a length of 100 mm, while a pad made of nylon having a thickness of 5 mm was used as the pad 4.

During plating the cylindrical electrode was rotated at 30 r.p.m. in the direction of the arrow a of FIG. 11 while the pad 4 was rotated at 2 r.p.m. in the direction of the arrow b of FIG. 11, thus realizing a plating speed of about 450 mm/min. The levels of the electrical current supplied between both electrodes during the plating, as well as the current density (a value obtained by dividing the current by the area of the pad 4 contacting the processed metal) are shown in Table 2. The conditions of the nickel plating on the thus obtained nickel-plated steel plates were observed and evaluated, the results being shown in Table 2. together with the criterion for evaluation of the respective evaluation items.

TABLE 2

| | Current (A) | Current density ($mA/cm^2$) | State of Ni plating |
|---|---|---|---|
| 1 | 1 | 40 | ○~◎ |
| 2 | 2 | 80 | ◎ |
| 3 | 3 | 120 | ◎ |
| 4 | 4 | 160 | ◎ |
| 5 | 5 | 200 | ◎ |

Evaluation criterion
Condition of Ni plating
Ni plate layer thickness and pin holes through microscopic observation of cross-section
◎: Uniform Ni plate layer with minimal number of pin holes
○: Substantially uniform Ni plate layer with few pin holes
X: Thin and non-uniform Ni plate layer with many pin holes It will be seen from Table 2 that the apparatus of the present invention is capable of performing nickel plating without any unevenness. In particular, excellent plating quality is obtainable when the plating current density ranges between 50 and 200 $mA/cm^2$.

As has been fully described, the electrolytic processing apparatus of the present invention can perform, at a low cost and with a high efficiency, various types of electrolytic processes on metallic materials, such as descaling, electrolytic acid cleaning, passivation, electrolytic polishing, coloring, plating and so forth.

Although this invention has been described with reference to specific forms of apparatus and method selected for illustration in the drawings, it will be appreciated that many variations may be practiced, including the substitution of equivalent elements and method steps for those particularly shown and described, the use of certain features independently of other features, and the reversal of parts or directions of rotation, all without departing from the spirit and scope of the invention, which is defined in the appended claims.

What is claimed is:

1. An apparatus for effecting an electrolytic process on a metallic member, comprising:

a rotatable cylindrical electrode arranged adjacent to said member to be processed, with a gap between them;

paste electrolyte supply means for supplying a paste electrolyte into the gap between said cylindrical electrode and said metallic member;

a pad disposed on the outer peripheral surface of said cylindrical electrode, which pad is constructed and arranged for retaining said paste electrolyte supplied by said paste electrolyte supply means;

electrical power supply means connected for causing an electric current to flow between said cylindrical electrode and said member across said gap in said paste electrolyte; and moving means for causing said metallic member and said cylindrical electrode to undergo relative movement therebetween.

2. An apparatus according to claim 1, wherein said paste electrolyte supply means includes a paste electrolyte supply system connected to supply said paste electrolyte to the surface of said pad on the outer surface of said cylindrical electrode.

3. An apparatus according to claim 1, wherein said paste electrolyte supply means includes a paste electrolyte supply system connected to supply said pad with said paste electrolyte from the interior of said cylindrical electrode.

4. An apparatus according to claim 2, wherein said pad is arranged in a spiral form on the outer peripheral surface of said cylindrical electrode.

5. An apparatus according to claim 2, wherein said pad includes a plurality of linear pad segments arranged on the outer peripheral surface of said cylindrical electrode such as to extend continuously or discontinuously in an axial direction on said cylindrical electrode.

6. An apparatus according to any one of claims 1 to 6, further comprising paste sealing means disposed in the vicinity of said cylindrical electrode and constructed and arranged to prevent scattering of said paste electrolyte from said metallic member.

7. An apparatus according to any one of claims 1 to 6, wherein said electrolytic processing system is arranged as two or more pairs along the path of movement of said member to be processed.

* * * * *